US005754613A

United States Patent [19]

Hashiguchi et al.

[11] Patent Number: 5,754,613

[45] Date of Patent: May 19, 1998

[54] POWER PLANT

[75] Inventors: Koh Hashiguchi, Yokohama; Nobuhiko Inai, Kamakura; Hiromichi Nei, Yokohama, all of Japan

[73] Assignee: Kabushiki Kaisha Toshiba, Kawasaki, Japan

[21] Appl. No.: 795,200

[22] Filed: Feb. 5, 1997

[30] Foreign Application Priority Data

Feb. 7, 1996 [JP] Japan ..... 8-021204

[51] Int. Cl.[6] ..... G21C 19/28; F01K 25/06

[52] U.S. Cl. ..... 376/378; 376/402; 60/649; 60/673

[58] Field of Search ..... 376/378, 402, 376/904; 60/649, 673

[56] References Cited

U.S. PATENT DOCUMENTS

| | | | |
|---|---|---|---|
| 4,489,563 | 12/1984 | Kalina | 60/673 |
| 5,572,871 | 11/1996 | Kalina | 60/649 |
| 5,649,426 | 7/1997 | Kalina et al. | 60/649 |

FOREIGN PATENT DOCUMENTS 4-27367 5/1992 Japan .

*Primary Examiner*—Michael J. Carone
*Assistant Examiner*—Matthew J. Lattig
*Attorney, Agent, or Firm*—Foley & Lardner

[57] ABSTRACT

The disclosed power plant can attain an extremely high thermal efficiency, as compared with that of the conventional power plant. The power plant comprises a steam system and a mixed medium system. The steam system comprises a heat source (1) for generating steam; a steam turbine (3) driven by the steam generated by the heat source; a steam condenser (81) for forming condensed water by condensing exhaust of the steam turbine; and a condensed water feeding pump (9) for feeding the water condensed by the steam condenser to the heat source. The mixed medium system comprises a heat exchanger (83) for exchanging heat between the exhaust of the steam turbine and a mixed medium; a separator (85) for separating the mixed medium heated by the heat exchanger (83) into liquid and vapor; a mixed medium turbine (95) driven by the mixed medium of vapor phase separated by the separator (85); a mixer (97) for mixing the exhaust of the mixed medium turbine with the mixed medium of liquid phase separated by the separator (85); a medium condenser (99) for forming condensed liquid by condensing the mixed medium mixed by the mixer; and a liquid feeding pump (102) for feeding the condensed liquid formed by the medium condenser to the heat exchanger (83).

12 Claims, 5 Drawing Sheets

POWER PLANT

BACKGROUND OF THE INVENTION

1. Field of the Invention

The present invention relates to a power plant, and more specifically to a power plant provided with both a steam system which uses steam (water vapor) to drive a turbine and a mixed medium system which uses a mixed medium to drive another turbine.

2. Description of the Prior Art

As the conventional power plants, nuclear power plants and thermal power plants are well known. FIG. 7 is a system diagram showing a boiling water reactor power plant (referred to as BWR, hereinafter).

In FIG. 7, a conventional BWR is provided with a nuclear reactor 200 for heating coolant (light water) to generate steam. Here, the steam generated by the nuclear reactor 200 is saturated steam. The generated steam is fed to a high pressure steam turbine 202 through a main steam pipe 201, to drive the high pressure steam turbine 202.

On the downstream side of the high pressure steam turbine 202, a moisture separator and reheater 203 is installed. This moisture separator and reheater 203 is connected to a heated steam pipe 204 branched from the main steam pipe 201 and to an extracted steam pipe 206 extending from the high pressure steam turbine 202. The steam exhausted by the high pressure steam turbine 202 is fed to the moisture separator and reheater 203. The exhausted steam fed to the moisture separator and reheater 203 is separated into water and vapor and further heated by high temperature steam fed thereto through the heated steam pipe 204 and the extracted steam pipe 206. The stream exhausted by the high pressure stream turbine 202 and further heated by the moisture separator and reheater 203 becomes superheated steam. The obtained superheated stream is fed to two low pressure steam turbines 205 to drive the low pressure turbines 205. Here, the high pressure steam turbine 202 and the low pressure steam turbines 205 are coupled coaxially with each other. Further, these turbines are coupled coaxially with an electric power generator (dynamo) 207. Therefore, when both the high pressure steam turbine 202 and the low pressure steam turbines 205 are driven by steam, it is possible to generate electric power by the generator 207.

On the downstream side of the low pressure steam turbines 205, a steam condenser 208 is installed. To this steam condenser 208, sea (salt) water is supplied through a circulating water pump (not shown). The steam exhausted by the low pressure stream turbines 205 is fed to the steam condenser 208, and cooled and condensed into water by salt water circulating within the steam condenser 208. On the downstream side of the steam condenser 208, a condenser pump 209 is installed. Further, on the downstream side of this condenser pump 209, a plurality of low pressure feed-water heaters 210 are arranged in series at multistage. Further, on the downstream side of the low pressure feed-water heaters 210, a turbine-driven or motor-driven water supply pump 211 is installed. In addition, on the downstream side of the water supply pump 211, two high pressure feed-water heaters 212 are installed. To the high pressure feed-water heaters 212, an extracted steam pipe 213 extending from the high pressure steam turbine 202 and a steam pipe 214 and a drain pipe 215 both extending from the moisture separator and reheater 203 are connected. Further, to the low pressure feed-water heaters 210, a drain pipe 216 extending from the high pressure feed-water heater 212 and an extracted steam pipe 217 extending from the low pressure steam turbine 205 are connected.

The water condensed by the steam condenser 208 is pressurized by the condenser pump 209, fed to the low pressure feed-water heaters 210, and further heated and pressurized by drain water fed through the drain pipe 216 and steam fed through the extracted steam pipe 217, respectively. The heated and pressurized condensed water is further pressurized by the water supply pump 211, fed to the high pressure feed-water heaters 212, and further heated to an appropriate subcooled temperature by steam and drain water fed through the extracted steam pipe 213, the steam pipe 214 and the drain pipe 215, respectively. The condensed water heated to an appropriate subcooled temperature is fed to the nuclear reactor 200 through a reactor feed-water pipe 218, heated again to steam by the nuclear reactor 200, and fed again to the high pressure steam turbine 202 through the main steam pipe 201.

In the above-mentioned conventional power plant, however, since electric power is generated in accordance with Rankin cycle by unitization of condensable steam, it has been difficult to increase the thermal efficiency. In the case of the nuclear power plant, in particular, since the saturated steam is used (superheated steam is difficult to use, being different from the thermal power plant), the thermal efficiency is lower than that of the thermal power plant. In other words, in the nuclear power plant, an improvement of the thermal efficiency is an important problem. However, this problem has not yet been solved sufficiently due to various restrictions. For instance, in the above-mentioned BWR or the pressurized water nuclear power plant (PWR), although the turbines are driven by use of steam heated to about 280° C., the thermal efficiency is about 33%, which is lower than that (40% or higher) of the thermal power plant.

Further, in order to increase the thermal efficiency of the BWR, although it may be considered to increase the temperature and pressure of steam on the outlet side of the nuclear reactor (to increase Rankine cycle efficiency), when the temperature and pressure of steam are simply increased in the current saturated steam cycle, there inevitably arise some problems in that the thermal performance of the reactor core deteriorates or that the wall thicknesses of the pressure vessel and the coolant pipe must be both increased to improve the pressure resistance performance.

In addition, in order to improve the thermal efficiency of the nuclear power plant, although it may be considered to increase only the steam temperature by forming superheated steam, in this case there arises another problem in that the reactor core must be designed in quite a different way from the conventional structure, with the result that the nuclear core structure is complicated, thus causing another problem in that it is difficult to control the nuclear reactor.

Further, in the nuclear power plant, since the steam is saturated steam on the turbine inlet side and thereby a great amount of moisture is generated during the expansion process, it has been necessary to take an appropriate countermeasure against the generated moisture. In the case of the lower pressure steam turbine, in particular, in order to prevent the turbine from corrosion, some countermeasures of higher cost are inevitably needed. For instance, the following methods have been so far adopted; moisture separating blades with moisture removing grooves on the back blades are used; a mechanism for exhausting moisture effectively from the turbine casing is additionally provided; a pipe for exhausting moisture is formed of chromium molybdenum steel, etc.

Further, in the case of the low pressure steam turbine used for the nuclear power plant, since the turbine is operated in a vacuum degree of about 38 mmHg, in order to transduce the steam expansion work to the rotational turbine energy, a large-sized turbine is needed. In addition, since a high steam tightness and a high vacuum degree retention are both required for the steam condenser, the high costly structure has been inevitably adopted.

Further, as the coolant of the nuclear reactor, it is possible to consider to use a medium having a boiling point which is lower than that of water, instead of the current light water, from the theoretical standpoint. When the lower boiling point medium (e.g., aqueous ammonia) is used, however, since the stability of the lower boiling point medium is extremely low against radioactive rays, the harmful substances resolved by the radioactive rays emitted from the nuclear core are inevitably formed, so that another problem arises in that a large-scaled installation for treating the gas resolved by the radioactive rays must be additionally installed. In practice, therefore, it has been impossible to use a low boiling point medium as the coolant of the nuclear reactor.

SUMMARY OF THE INVENTION

With these various problems in mind, therefore, it is the object of the present invention to provide a power plant which can attain an extremely high thermal efficiency, as compared with that of the conventional power plant.

To achieve the above-mentioned object, the present invention provides a power plant, comprising: a steam system having: a heat source for heating a water to generate a steam; a steam turbine driven by the steam generated by said heat source; a steam condenser for forming a condensed water by condensing an exhaust of said steam turbine; and condensed water feeding means for feeding the condensed water produced by said steam condenser to said heat source; and a mixed medium system having: heat exchanging means for exchanging heat between the exhaust of said steam turbine and a mixed medium; high pressure separating means for separating the mixed medium heated by said heat exchanging means into liquid and vapor; a mixed medium turbine driven by the mixed medium of vapor phase separated by said high pressure separating means; first medium condensing means for forming a condensed liquid by condensing an exhaust of said mixed medium turbine; first condensed liquid heating means for heating the condensed liquid formed by said first medium condensing means; intermediate pressure separating means for separating the condensed liquid heated by said first condensed liquid heating means into liquid and vapor; first condensed liquid feeding means for feeding the condensed liquid formed by said first medium condensing means to said intermediate pressure separating means; mixing means for mixing the mixed medium of liquid phase separated by said intermediate pressure separating means with the exhaust of said mixed medium turbine on upstream side of said first medium condensing means; second medium condensing means for forming a condensed liquid by cooling the mixed medium of vapor phase separated by said intermediate pressure separating means; second condensed liquid feeding means for feeding the condensed liquid formed by said second medium condensing means to said heat exchanging means; and first separated liquid feeding means for feeding the mixed medium of liquid phase separated by said high pressure separating means to said intermediate pressure separating means.

Further, it is preferable that the condensed liquid formed by said first medium condensing means is heated at the same time that the mixed medium of vapor phase separated by said intermediate pressure separating means is cooled, by exchanging heat between the condensed liquid and the mixed medium of vapor phase.

Further, it is preferable that the power plant further comprises: second condensed liquid heating means for heating the condensed liquid formed by said second medium condensing means; intermediate high pressure separating means for separating the condensed liquid heated by said second condensed liquid heating means into liquid and vapor; third medium condensing means for forming a condensed liquid by cooling the mixed medium of vapor phase separated by said intermediate high pressure separating means; and second separated liquid feeding means for feeding the mixed medium of liquid phase separated by said high pressure separating means to said intermediate high pressure separating means; and wherein said second condensed liquid feeding means feeds the condensed liquid formed by said third medium condensing means to said heat exchanging means; and said first separated liquid feeding means feeds the mixed medium of liquid phase separated by said intermediate high pressure separating means to said intermediate pressure separating means.

Further, it is preferable that the condensed liquid formed by said second medium condensing means is heated at the same time that the mixed medium of vapor phase separated by said intermediate high pressure separating means is cooled, by exchanging heat between the condensed liquid and the mixed medium of vapor phase.

Further, it is preferable that the power plant further comprises: a small-sized steam condenser for condensing the steam within said steam condenser which contains non-condensable gas; and non-condensable gas treating means for treating the non-condensable gas existing within said small-sized steam condenser.

Further, it is preferable that said heat source is a nuclear reactor.

Further, it is preferable that the mixed medium is a mixture which contains at least a water and an ammonia.

Further, the present invention provides a power plant, comprising: a steam system having: a heat source for heating a water to generate a steam; a steam turbine driven by the steam generated by said heat source; a steam condenser for forming a condensed water by condensing an exhaust of said steam turbine; and condensed water feeding means for feeding the water condensed by said steam condenser to said heat source; and a mixed medium system having: heat exchanging means for exchanging heat between the exhaust of said steam turbine and a mixed medium; separating means for separating the mixed medium heated by said heat exchanging means into liquid and vapor; a mixed medium turbine driven by the mixed medium of vapor phase separated by said separating means; mixing means for mixing the exhaust of said mixed medium turbine with the mixed medium of liquid phase separated by said separating means; medium condensing means for forming a condensed liquid by condensing the mixed medium mixed by said mixing means; and condensed liquid feeding means for feeding the condensed liquid formed by said medium condensing means to said heat exchanging means.

Further, it is preferable that said steam turbine includes: a high pressure steam turbine driven by the steam generated by said heat source; and a low pressure turbine driven by an exhaust of said high pressure steam turbine; and wherein said heat exchanging means exchanges heat between the exhaust of said low pressure steam turbine and the mixed medium.

Further, it is preferable that the power plant further comprises: a small-sized steam condenser for condensing the steam within said steam condenser which contains non-condensable gas; and non-condensable gas treating means for treating the non-condensable gas existing within said small-sized steam condenser.

Further, it is preferable that said heat source is a nuclear reactor.

Further, it is preferable that the mixed medium is a mixture which contains at least a water and an ammonia.

DETAILED DESCRIPTION OF THE EMBODIMENTS

(First embodiment)

A first embodiment of the power plant according to the present invention will be described hereinbelow with reference to FIG. 1.

In this first embodiment, the power plant is provided with both a steam system for generating power by using steam (water vapor) and a mixed medium system for generating power by using a mixed medium.

First, the steam system of the power plant will be described hereinbelow.

Figure 1:
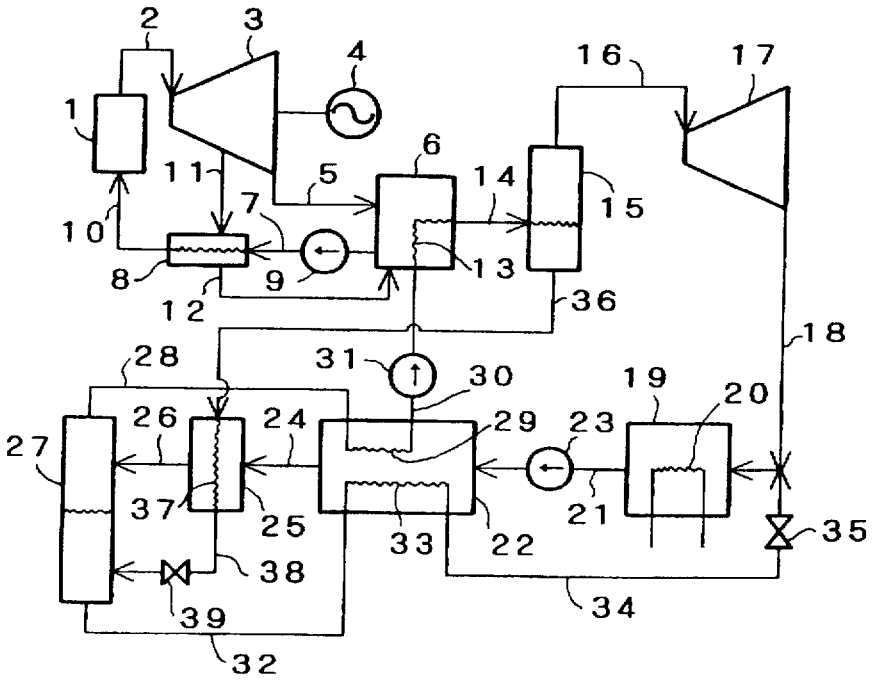
FIG. 1 is a system diagram showing a first embodiment of the power plant according to the present invention.

In FIG. 1, the power plant 1 is provided with a nuclear reactor (heat source) for generating steam by heating a coolant, i.e., light water. The outlet side of the nuclear reactor 1 is connected to an inlet side of a high pressure steam turbine 3 through a main steam pipe 2. Further, the high pressure steam turbine 3 is coupled coaxially with an electric power generator 4. The outlet side of the high pressure steam turbine 3 is connected to the inlet side of a steam condenser 6 through an exhaust pipe 5, and the outlet side of the steam condenser 6 is connected to the inlet side of a high pressure feed-water heater 8 through a condensed water pipe 7. A turbine-driven or motor-driven type water supply pump (condensed water feeding means) 9 is provided midway of the condensed water pipe 7. The outlet side of the high pressure feed-water heater 8 is connected to the inlet side of the nuclear reactor 1 through a reactor feed-water pipe 10. Further, to the high pressure feed-water heater 8, a high pressure turbine extracted steam pipe 11 for feeding the extracted steam from the high pressure steam turbine 3 and a drain pipe 12 for feeding drain water to the steam condenser 6 are both connected.

Next, the mixed medium system of the power plant will be described hereinbelow.

Within the steam condenser 6, an intra-condenser heat exchange element (heat exchanging means) 13 is provided. The mixed medium is flowing through at least part of the intra-condenser heat exchange element 13. Here, the mixed medium flowing through the inside of the intra-condenser heat exchange element 13 is a medium which contains two or more components. At least one of these components for constituting the mixed medium is a substance having a boiling point lower than that of water (a lower boiling point component). An example of the mixed medium is a mixture of at least water and ammonia.

The outlet side of the intra-condenser heat exchange element 13 provided within the steam condenser 6 is connected to a high pressure separator (high pressure separating means) 15 through a pipe 14, and the high pressure separator 15 is connected to the inlet side of a mixed medium turbine 17 through a pipe 16. The mixed medium turbine 17 is coupled coaxially with the high pressure steam turbine 3 and the power generator 4. The outlet side of the mixed medium turbine 17 is connected to the inlet side of a medium condenser (first medium condensing means) 19 through an exhaust pipe 18. Within the medium condenser 19, a heat exchange element 20 is provided, and cooling salt water is flowing through the inside of the heat exchange element 20. The outlet side of the medium condenser 19 is connected to the inlet side of a triple heat exchanger 22 through a pipe 21, and an intermediate pressure pump (first condensed liquid feeding means) 23 for mixed medium is provided midway of the pipe 21.

The outlet side of the triple heat exchanger 22 is connected to the inlet side of a heat exchanger 25 through a pipe 24, and the outlet side of the heat exchanger 25 is connected to an intermediate pressure separator (intermediate pressure separating means) 27 through a pipe 26. The outlet side of the intermediate pressure separator 27 is connected to the triple heat exchanger 22 through a pipe 28, and the pipe 28 is connected to an inlet end of a first heat exchange element (second medium condensing means) 29 provided within the triple heat exchanger 22. The outlet end of the first heat exchange element 29 is connected to the inlet end of the intra-condenser heat exchange element 13 provided within the steam condenser 6 through a pipe 30. Further, a high pressure pump (second condensed liquid feeding means) 31 for pressurizing the mixed medium is provided midway of the pipe 30.

Further, under the intermediate pressure separator 27, an end of a pipe 32 for feeding the condensed mixed medium to the triple heat exchanger 22 is connected, and the other end of this pipe 32 is connected to the inlet end of a second heat exchange element (first condensed liquid heating means) 33 provided within the triple heat exchanger 22. The outlet end of the second heat exchange element 33 is connected to a midway portion of the exhaust pipe 18 through a pipe 34, and a pressure reduction valve (mixing means) 35 is provided midway of the pipe 34.

Further, to the lower portion of the high pressure separator 15, an end of a pipe 36 for feeding the condensed mixed medium to the heat exchanger 25 is connected, and the other end of the pipe 36 is connected to an inlet end of a heat exchange element 37 provided within the heat exchanger 25. The outlet end of the heat exchange element 37 is connected to the intermediate pressure separator 27 through a pipe 28, and a pressure reduction value (first separated liquid feeding means) 39 is provided midway of the pipe 38.

The operation of the first embodiment constructed as stated above will be described hereinbelow.

The coolant of light water is heated by the nuclear reactor 1 into saturated steam, and then fed to the high pressure steam turbine 3 through the main steam pipe 2. The steam fed to the high pressure steam turbine 3 drives the high pressure steam turbine 3, so that the rotational energy of the turbine is transduced into electric energy by the power generator 4. The steam exhausted from the high pressure steam turbine 3 is fed to the steam condenser 6 through the exhaust pipe 5, and then cooled and condensed by the mixed medium flowing through the intra-condenser heat exchange element 13. Here, the internal pressure of the steam condenser 6 is determined to a pressure near or beyond the atmospheric pressure. The condensed water formed by the steam condenser 6 is pressurized by the water supply pump 9, and then fed to the high pressure feed-water heater 8 through the condenser pipe 7. The condensed water fed to the high pressure feed-water heater 8 is heated by the steam extracted from the high pressure turbine extracted steam pipe 11, and recirculated into the nuclear reactor 1 through the reactor feed-water pipe 10, after having been heated to an appropriate subcooled temperature.

On the other hand, the mixed medium heated by the steam exhausted from the high pressure steam turbine 3 in the steam condenser 6 is fed to the high pressure separator 15 through the pipe 14, after having been boiled into a two-phase stream. The mixed medium fed to the high pressure separator 15 is separated by distillation into a liquid phase portion (formed of liquid) and a vapor phase portion (composed of superheated vapor without moisture). In the superheated vapor of the mixed medium (which forms the vapor phase portion), the concentration (abundance ratio) of the low boiling point component is heightened. For instance, the mass ratio of the components having a low boiling point is about 0.85. The superheated vapor which contains the rich low boiling point components is fed to the mixed medium turbine 17 through the pipe 16, to drive the same turbine by its expansion work. Here, the conditions of the vapor existing on the inlet side of the mixed medium turbine 17 are 190° C. in temperature and 10,000 kPa in pressure. Since the mixed medium turbine 17 is coupled coaxially with the high pressure steam turbine 3 and the power generator 4, the rotational energy of the mixed medium turbine 17 can be transduced into electric energy by the power generator 4.

The mixed medium exhausted from the mixed medium turbine 17 is fed to the medium condenser 19 through the exhaust pipe 18. Here, when being fed, the exhausted mixed medium is mixed with another mixed medium which contains low boiling point components of an extremely low concentration (e.g., 0.16 in mass ratio) and which is fed through the pipe 34. Therefore, the mass ratio of the low boiling point components is reduced from about 0.85 (before being mixed on the inlet side of the turbine 17) to about 0.3 (after having been mixed). Here, the mixed medium to be mixed with the medium exhausted by the mixed medium turbine 17 is a mixed medium of liquid phase portion separated by distillation in the intermediate pressure separator 27. In more detail, the mixed medium of liquid phase portion is fed from the liquid phase portion of the intermediate pressure separator 27 to the triple heat exchanger 22 through the pipe 32, cooled by the second heat exchange element 33 of the triple heat exchanger 22, and then mixed with the medium exhausted by the mixed medium turbine 17.

After having been mixed with the mixed medium which contains the low boiling point components of an extremely low concentration, the exhausted medium of the mixed medium turbine 17 is fed to the medium condenser 19, and thereby cooled and condensed into liquid by the salt water (of the normal temperature) flowing through the heat exchange element 20 of the medium condenser 19. Here, since the exhausted medium of the mixed medium turbine 17 is mixed with the mixed medium which contains the low boiling point components of an extremely low concentration and thereby since the mass ratio of the low boiling point components is reduced down to about 0.3, the internal pressure of the medium condenser 19 is about 100 kPa; that is, can be maintained at roughly the atmospheric pressure. Further, since the vapor conditions on the inlet side of the mixed medium turbine 17 are set to 190° C. and 10,000 kPa, it is possible to obtain an extremely high heat drop in the mixed medium turbine 17.

The mixed medium condensed to liquid by the medium condenser 19 is pressurized to about 1,000 kPa by the medium pump 23, and then introduced into the triple heat exchanger 22. Here, vapor and liquid of the high temperature mixed medium fed from the intermediate pressure separator 27 through the pipes 28 and 32 are flowing through the first heat exchange element 29 and the second heat exchange element 33 of the triple heat exchanger 22, respectively. The flowing direction of these two streams is opposite to that of the mixed medium introduced into the triple heat exchanger 22 through the pipe 21. Therefore, the condensed mixed medium fed through the pipe 21 can be heated effectively by the heat exchange through the first and second heat exchange elements 29 and 33 of the triple heat exchanger 22. After having been changed to a two-phase stream, the heated mixed medium is fed to the heat exchanger 25 through the pipe 24. Therefore, the mixed medium is further heated by a high temperature mixed medium of liquid phase portion fed from the high pressure separator 15 and flowing through the heat exchange element 37 of the heat exchanger 25, so that it is possible to increase the proportion of the vapor for forming the vapor phase in the two-phase stream.

The mixed medium of two-phase stream heated by the heat exchanger 25 is fed to the intermediate pressure separator 27 through the pipe 26. Further, after having been decompressed by the pressure reduction valve 39, the mixed medium passed for heat exchange through the heat exchange element 37 of the heat exchanger 25 is introduced into the intermediate pressure separator 27 through the pipe 38. Here, since the inside of the intermediate pressure separator 27 is kept at about 135° C., the internal mixed medium is separated by distillation to liquid phase portion and vapor phase portion. The mass ratio of the low boiling point components in vapor for forming the vapor phase is about 0.37, and the mass ratio of the low boiling point components in liquid for forming the liquid phase portion is about 0.16.

The vapor separated by distillation by the intermediate pressure separator 27 is fed to the triple heat exchanger 22 through the pipe 28, and cooled and condensed by heat exchange down to about 40° C. by the first heat exchange element 29. The mixed medium of liquid phase portion is pressurized up to 10,000 kPa by the high pressure pump 31, and then fed to the steam condenser 6 through the pipe 30. The mixed medium of liquid phase portion fed to the steam condenser 6 is heated up to about 190° C. by the steam exhausted by the high pressure turbine 3 and flowing through the heat exchange element 13 of the steam condenser 6. The heated mixed medium is boiled into a two-phase stream, and then circulated into the high pressure separator 15 through the pipe 14.

As described above, in the first embodiment of the power plant according to the present invention, electricity can be generated on the basis of two systems comprising the steam system and the mixed medium system; the mixed medium which contains components having a boiling point lower than that of water is used; a two-stage separator composed of the high pressure separator 15 and the intermediate pressure separator 27 is installed; and the concentration (abundance ratio) of the low boiling point components in the mixed medium is changed before and after the mixed medium turbine 17. Therefore, since the vapor conditions on the inlet side of the mixed medium turbine 17 can be optimized so as to secure a sufficient back pressure, the driving force of the mixed medium turbine 17 driven by the vapor of the mixed medium can be increased, so that it is possible to improve the thermal efficiency markedly in comparison with the ordinary Rankin cycle. In particular, since the two-state separators 15 and 27 for high pressure and intermediate pressure, respectively are both installed, it is possible to increase a difference in concentration of the low boiling point components between before and after the mixed medium turbine 17. As a result, in the case where the vapor temperature on the inlet side of the mixed medium turbine 17 is set to 190° C. and further the ordinary salt water is used as the cooling medium flowing through the heat exchange element 20 of the medium condenser 19, it is possible to increase the thermal efficiency of only the mixed medium system up to about 34%. This thermal efficiency is extremely high in comparison with that obtained by the conventional power plant in which the temperature of the turbine is set to about 190° C. on the inlet side thereof. Further, as the whole power plant including the steam system, it is possible to attain as high a thermal efficiency as about 41%. Therefore, when the first embodiment is applied to the conventional BWR having a thermal efficiency of about 33%, it is possible to attain power generation of 1,350,000 kW class in the power plant of 1,100,000 kW class.

Further, in the first embodiment, since the back pressure of the mixed medium turbine 17 can be set to or near the atmospheric pressure, the number of expansion stages of the mixed medium turbine 17 can be reduced and thereby the mixed medium turbine can be small-sized. In addition, since the countermeasures of the medium condenser 19 against a high vacuum are not required, it is possible to reduce the manufacturing cost thereof. Further, since being different from the conventional BWR low pressure steam turbine, it is unnecessary to form moisture-removing grooves on the back blades, to provide a structure for removing moisture effectively from the turbine casing, or to install moisture removing pipes formed of a costly chromium steel, with the result that the manufacturing cost can be further reduced.

Further, since the inner pressure of the steam condenser 6 can be set to or near the atmospheric pressure in the same way as with the case of the medium condenser 19, the countermeasures of the steam condenser 6 against a high vacuum are not required, so that it is possible to reduce the manufacturing cost thereof markedly.

Further, since electric power is generated by the steam system using light water as the coolant of the nuclear reactor 1 in the same way as is conventional and in addition by the mixed medium system (separated from the steam system) using the mixed medium, it is possible to avert such a problem that harmful substances (corrosive substances) are produced due to the radiolyses of the mixed medium.

Further, although the first embodiment applied to the power plant using the nuclear reactor 1 as a heat source has been described above by way of example, without being limited only thereto, it is of course possible to apply the first embodiment of the present invention to various power plants which use thermal energy, geothermal energy, waste heat recovery energy, etc. as the heat source.

(Second embodiment)

A second embodiment of the power plant according to the present invention will be described hereinbelow with reference to FIG. 2, in which the same reference numerals have been retained for similar elements having the same functions as with the case of the first embodiment shown in FIG. 1, without repeating the similar description thereof.

Figure 2:
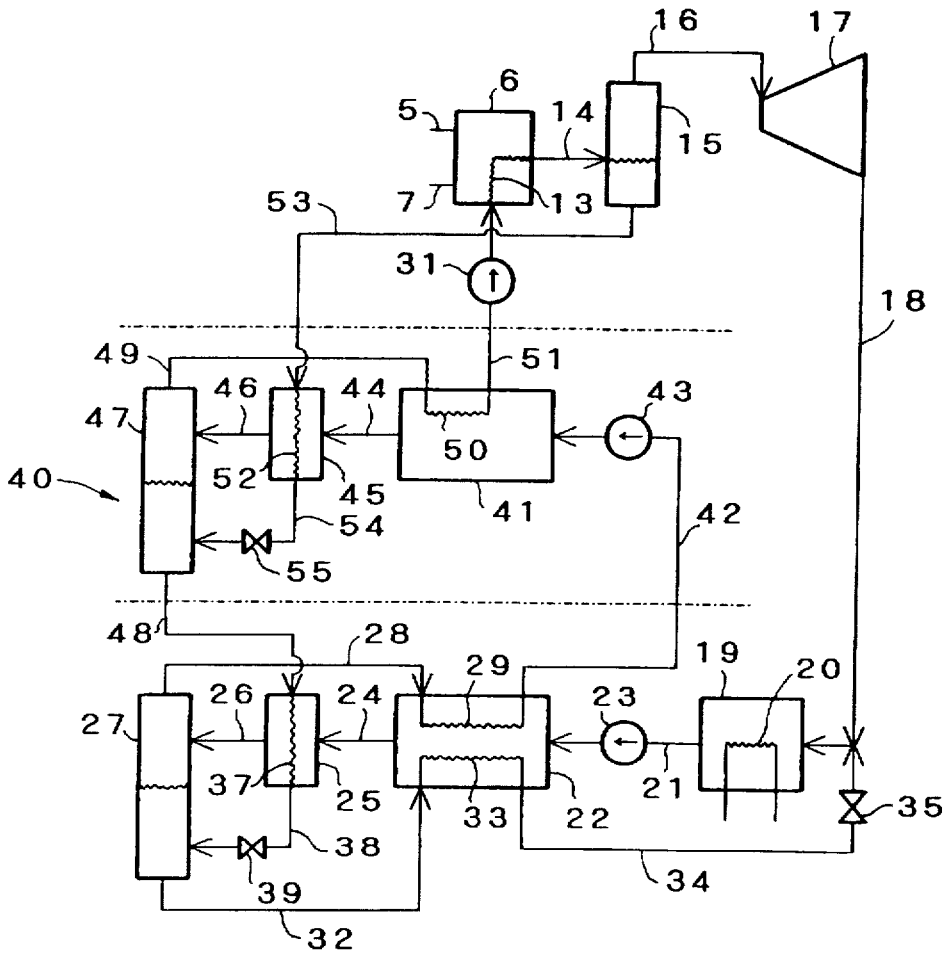
FIG. 2 is a system diagram showing a second embodiment of the power plant according to the present invention.

In this second embodiment, as shown in FIG. 2, a separating system 40 is additionally installed. The added separating system 30 is provided with a first heat exchanger (a third medium condensing means) 41. The inlet end of the first heat exchanger 41 is connected to the outlet end of the first heat exchange element 29 of the triple heat exchanger 22 through a pipe 42. Further, an intermediate high pressure pump 43 is provided midway of the pipe 42. This intermediate high pressure pump 43 has an intermediate discharge pressure between those of the intermediate pressure pump 23 and the high pressure pump 31.

Further, the outlet side of the first heat exchanger 41 is connected to the inlet side of a second heat exchanger 45 through a pipe 44, and the outlet side of the second heat exchanger 45 is connected to an intermediate high pressure separator (intermediate high pressure separating means) 47 through a pipe 46. The lower portion of the intermediate high pressure separator 47 is connected to the inlet end of the heat exchanger element 37 of the heat exchanger 25 through a pipe 48. On the other hand, the upper portion of the intermediate high pressure separator 47 is connected to an inlet end of a heat exchange element (a second condensed liquid heating means) 50. Further, an outlet end of the heat exchange element 50 of the first heat exchanger 41 is connected to an inlet end of an intra-condenser heat exchange element 13 of the steam condenser 6 through a pipe 51. Further, a high pressure pump 31 is provided midway of a pipe 51.

Further, a heat exchange element 52 is provided within the second heat exchanger 45. An inlet end of the heat exchange element 52 is connected to the lower portion of the high pressure separator 15 through a pipe 53. On the other hand, an outlet end of the heat exchange element 52 is connected to the intermediate high pressure separator 47 through a pipe 54. Further, a pressure reduction valve (second separated liquid feeding means) 55 is provided midway of a pipe 54.

The operation of the second embodiment will be described hereinbelow, without repeating the similar operation as with the case of the first embodiment.

The mixed medium vapor fed from the vapor phase portion of the intermediate pressure separator 27 is fed to the triple heat exchanger 22 through the pipe 28, and cooled and condensed into liquid by heat exchange when flowing through the heat exchange element 29 of the triple heat exchanger 22. The mixed medium of liquid phase portion is pressurized by the intermediate high pressure pump 43, introduced into the first heat exchanger 41 through the pipe 42, heated by the high temperature vapor of mixed medium fed from the intermediate high pressure separator 47 and flowing through the heat exchange element 50, and then introduced into the second heat exchanger 45 through the pipe 44 as a two-phase stream. The mixed medium flowing through the second heat exchanger 45 is further heated by the high temperature liquid portion of the mixed medium fed from the high pressure separator 15 and flowing through the heat exchange element 52, so that the proportion of vapor for forming the vapor phase portion of the two-phase stream can be increased.

The mixed medium of the two-phase stream heated by the second heat exchanger 45 is introduced into the intermediate high pressure separator 47 through the pipe 46. Further, the mixed medium flowing through the heat exchange element 52 of the second heat exchanger 45 is passed through the pipe 54, depressurized by a pressure reduction valve 55, and then introduced into the intermediate high pressure separator 47. The mixed medium introduced into the intermediate high pressure separator 47 is separated by distillation into the vapor phase portion and the liquid phase portion. The vapor for forming the vapor phase portion is fed to the first heat exchanger 41 through the pipe 49, and cooled and condensed into liquid by the heat exchange element 50. The liquefied mixed medium is pressurized by the high pressure pump 31 beyond 10,000 kPa, and then fed to the steam condenser 6 through the pipe 51.

As described above, in the second embodiment, since the separating system 40 is installed in addition to the construction of the first embodiment, it is possible to secure the thermal drop of the mixed medium turbine 17 more reliably in comparison with the first embodiment. Therefore, the mixed medium whose condensation and boiling curves are closed to each other can be used more easily as the mixed medium for driving the mixed medium turbine 17, so that the thermal efficiency of the power plant can be further improved. As the practical example of the mixed medium, there are a mixture composed of two or more organic compounds which contain alcohol or ketone, a mixture composed of two or more flon-based substances, a mixture composed of water and two or more hydrophilic organic compounds (alcohol, etc.), a mixture composed of two or more organic compounds which contain alcohol or ketone and flon-based substances, etc.

(Third embodiment)

A third embodiment of the power plant according to the present invention will be described hereinbelow with reference to FIG. 3, in which the same reference numerals have been retained for similar elements having the same functions as with the case of the first and second embodiments shown in FIGS. 1 and 2, without repeating the similar description thereof.

Figure 3:
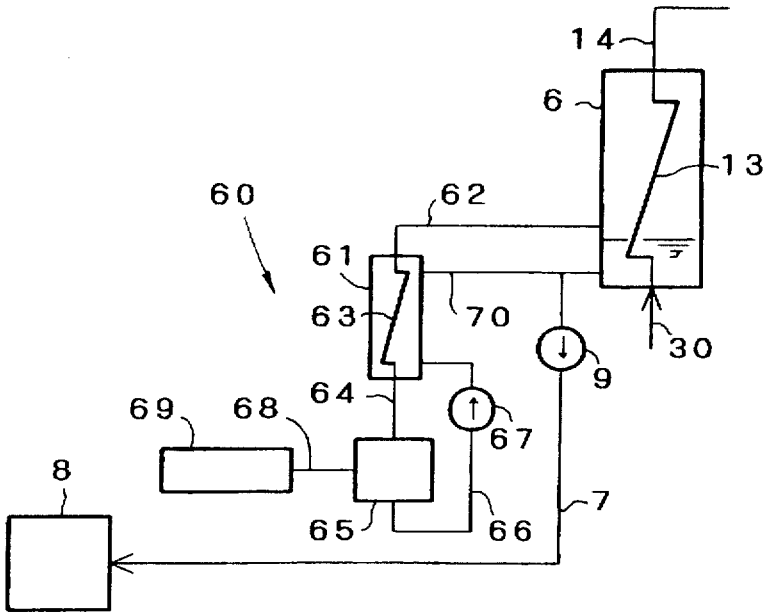
FIG. 3 is a system diagram showing a third embodiment of the power plant according to the present invention.

In this third embodiment, as shown in FIG. 3, means for treating non-condensable gas (e.g., hydrogen gas or oxygen gas) produced by the radiolyses due to the radiations from the nuclear reactor is installed in addition to the first and second embodiments.

In FIG. 3, a non-condensable gas treating system (noncondensable gas treating means) 60 added to the configuration of the first or second embodiments is shown. The non-condensable gas treating system 60 is provided with a heat exchanger 61 connected to the steam condenser 6 through a pipe 62. One end of the pipe 62 is connected to the steam condenser 6 at such a position a little above the liquid surface level of the condensed water accumulated at the bottom portion of the steam condenser 6. Further, the internal pressure of the steam condenser 6 is maintained near or above the atmospheric pressure, as already explained.

A heat exchange element 63 is provided within the heat exchanger 61. An inlet end of this heat exchange element 63 is connected to the other end of the pipe 62. On the other hand, an outlet end of the heat exchange element 63 is connected to an inlet side of a small-sized steam condenser 65 through a pipe 64. The inside of this small-sized steam condenser 65 is kept at a high vacuum. An outlet side of the small-sized steam condenser 65 is connected to the heat exchanger 61 through a pipe 66, and a small-sized condensed water pump 67 is provided midway of the pipe 66. Further, an extracted steam degassing system 69 is connected to the small-sized steam condenser 65 through a pipe 68. The extracted steam degassing system 69 is provided with an ejector (not shown), a recombiner (not shown) for recombining radiolysis product gas, etc. Further, the heat exchanger 61 is connected to a water supply pump 9 and the steam condenser 6 through a pipe 70, and the water supply pump 9 is connected to a high pressure feed-water heater 8 through a pipe 7.

The operation of the third embodiment will be described hereinbelow, without repeating the similar function as with the case of the first and second embodiments.

First, steam of less than about one % is taken out of the steam which contains non-condensable gas from above the liquid surface of the condensed water accumulated at the bottom portion of the steam condenser 6, and then fed into the heat exchanger 61 through the pipe 62. When being passed through the heat exchanger 63, the steam fed to the heat exchanger 61 through the pipe 62 is cooled by the condensed water fed from the small-sized steam condenser 65 through the pipe 66 and introduced into the heat exchanger 61. The cooled steam is introduced into the small-sized steam condenser 65 through the pipe 64, and then condensed into water under a high vacuum. On the other hand, the non-condensable gas contained in the steam is extracted from the small-sized steam condenser 65 through the pipe 68, and then treated by the extracted steam degassing system 69. The condensed water formed by the small-sized steam condenser 65 is pressurized by the small-sized condensed water pump 67, and then fed to the heat exchanger 61 through the pipe 66. The condensed water fed to the heat exchanger 61 is heated by the heat exchange element 63, and then fed to a suction side of the water supply pump 9 through the pipe 70.

As described above, in the third embodiment, since the non-condensable gas produced by the radiolyses due to the radiations from the nuclear reactor can be treated by the non-condensable gas treating system considerably smaller than the conventional treating system installed in a nuclear power plant, it is possible to reduce the manufacturing cost thereof markedly.

(Fourth embodiment)

A fourth embodiment of the power plant according to the present invention will be described hereinbelow with reference to FIG. 4, in which the same reference numerals have been retained for similar elements having the same functions as with the case of the first to third embodiments shown in FIGS. 1 to 3, without repeating the similar description thereof.

Figure 4:
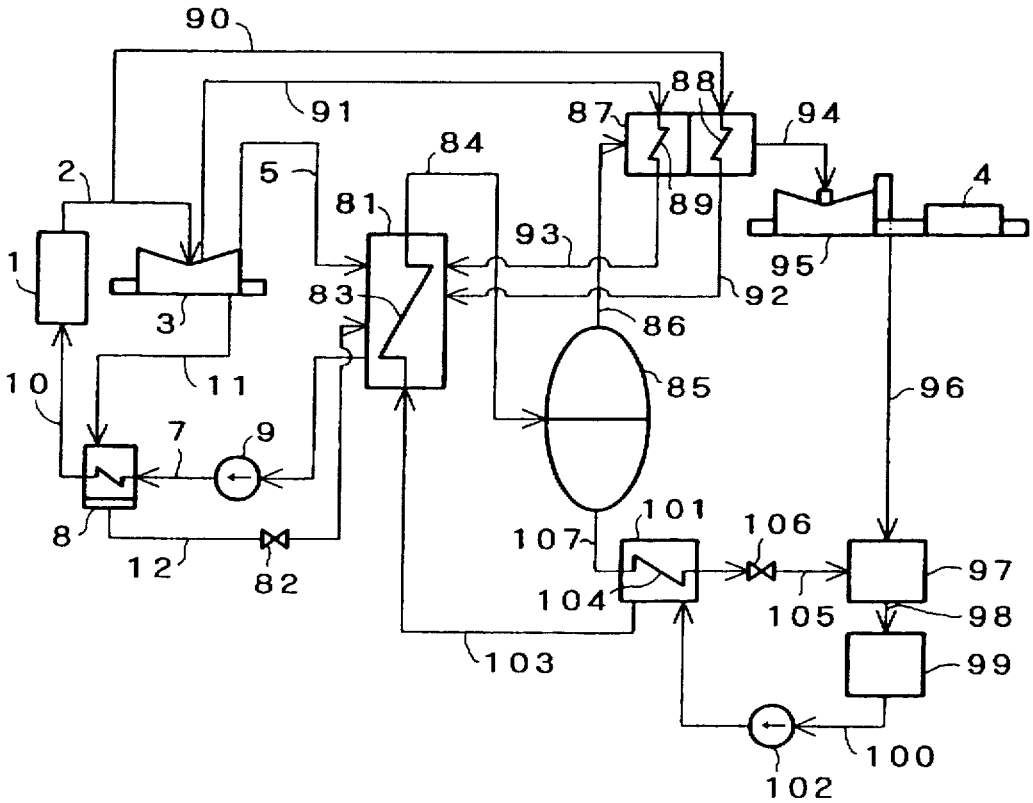
FIG. 4 is a system diagram showing a fourth embodiment of the power plant according to the present invention.

In this fourth embodiment, as shown in FIG. 4, a steam system for generating electric power by use of steam and a mixed medium system for generating electric power by use of a mixed medium are both provided.

First, the steam system of the power plant will be described.

In FIG. 4, the power plant is provided with a nuclear reactor 1 for heating a coolant of light water to generate steam. The outlet side of the nuclear reactor 1 is connected to an inlet side of the high pressure steam turbine 3 through the main steam pipe 2. The high pressure steam turbine 3 is coupled coaxially with the electric power generator 4. The outlet side of the high pressure turbine 3 is connected to the inlet side of the steam condenser 81 through the exhausted steam pipe 5. The outlet side of the steam condenser 81 is connected to the inlet side of the high pressure feed-water heater 8 through the condenser pipe 7. Further, the turbine-driven or motor-driven type water supply pump 9 is provided midway of the condenser pipe 7. The outlet side of the high pressure feed-water heater 8 is connected to the inlet side of the nuclear reactor through the reactor feed-water pipe 10. Further, to the feed-water heater 8, the high pressure turbine extracted steam pipe 11 for feeding steam extracted from the high pressure steam turbine 3, and the drain pipe 12 for feeding drained water to the steam condenser 81 are both connected, respectively. Further, a valve 82 is provided midway of the drain pipe 12.

Successively, the mixed medium system of the power plant will be described.

In FIG. 4, an intra-condenser heat exchange element (heat exchanging means) 83 is provided within the steam condenser 81. The mixed medium is flowing through at least a part of the intra-condenser heat exchange element 83. Here, the mixed medium flowing through the intra-condenser heat exchange element 83 contains two or more components, and at least one component of these components for constituting the mixed medium is a substance having a boiling point lower than that of water. As an example of the mixed medium, there is a mixture of water and ammonia.

The outlet side of the intra-condenser heat exchange element 83 of the steam condenser 81 is connected to a separator (separating means) 85 through a pipe 84, and the separator 85 is connected to the inlet side of a heat exchanger 87 through a pipe 86. Within the heat exchanger 87, a first heat exchange element 88 and a second heat exchange element 89 are provided. An inlet end of the first heat exchange element 88 is connected to a midway portion of the main steam pipe 2 through a main extracted steam pipe 90, and an inlet end of the second heat exchange element 89 is connected to the high pressure steam turbine 3 through an extracted steam pipe 91. Further, two outlet ends of the first and second heat exchange elements 88 and 89 are connected to the steam condenser 81 through two pipes 92 and 93, respectively.

An outlet side of the heat exchanger 87 is connected to an inlet side of a mixed medium turbine 95 through a pipe 94. The mixed medium turbine 95 is coupled coaxially with a high pressure steam turbine 3 and the electric power generator 4. The outlet side of the mixed medium turbine 95 is connected to an inlet side of a mixer (mixing means) 97 through an exhausted steam pipe 96. An outlet side of the mixer 97 is connected to an inlet side of a medium condenser (medium condensing means) 99 through a pipe 98. A heat exchange element (not shown) is provided within the medium condenser 99, and salt water is flowing through the inside of the heat exchange element. An outlet side of the medium condenser 99 is connected to an inlet side of a heat exchanger 101, and a liquid supply pump (condensed liquid feeding means) 102 is provided midway of a pipe 100. An outlet side of the heat exchanger 101 is connected to the inlet end of the intra-condenser heat exchange element 83 of the steam condenser 81 through a pipe 103. Further, a heat exchange element 104 is provided within the heat exchanger 101. An outlet end of the heat exchange element 104 is connected to the mixer 97 through a pipe 105. A pressure reduction valve (mixing means) 106 is provided midway of the pipe 105. Further, the pressure reduction valve 106 can be replaced with an orifice. An inlet end of the heat exchange element 104 is connected to the lower portion of the separator 85 through a pipe 107.

The operation of the fourth embodiment constructed as described above will be described hereinbelow.

The coolant of light water is heated by the nuclear reactor 1 into saturated steam, and then fed to the high pressure steam turbine 3 through the main steam pipe 2. The steam fed to the high pressure steam turbine 3 drives the high pressure steam turbine 3, so that the rotational energy of the steam turbine 3 can be transduced into electric energy by the power generator 4. The steam exhausted from the high pressure steam turbine 3 is fed to the steam condenser 81 through the exhaust pipe 5, and then cooled and condensed by the mixed medium flowing through the intra-condenser heat exchange element 83. Here, the internal pressure of the steam condenser 81 is determined to a pressure near or beyond the atmospheric pressure. The condensed water formed by the steam condenser 81 is pressurized by the water supply pump 9, and then fed to the high pressure feed-water heater 8 through the condenser pipe 7. The condensed water fed to the high pressure feed-water heater 8 is heated by the steam fed through the high pressure turbine extracted steam pipe 11, and then recirculated into the nuclear reactor 1 through the reactor feed-water pipe 10, after having been heated to an appropriate subcooled temperature.

On the other hand, the mixed medium flowing through the intra-condenser heat exchange element 83 of the steam condenser 81 is heated by the steam flowing from the high pressure steam turbine 3 to the steam condenser 81 through the exhaust pipe 5, by the extracted main steam flowing into the steam condenser 81 through the pipe 92, and by the steam extracted from the high pressure steam turbine 3 and fed into the steam condenser 81 through the pipe 93. After having been boiled into a two-phase stream, the mixed medium heated by the steam condenser 81 is fed to the separator 85 through the pipe 84.

The mixed medium fed to the separator 85 is separated by distillation using gravity into a liquid phase portion (formed of liquid) and a vapor phase portion (formed of vapor). In the vapor of the mixed medium (which forms the vapor phase portion), the concentration (abundance ratio) of the low boiling point component is heightened. The vapor which contains a large quantity of low boiling point components is fed to the heat exchanger 87 through the pipe 86. The vapor of the mixed medium fed to the heat exchanger 87 is heated to superheated vapor by the main steam extracted from the nuclear reactor 1 and flowing through the first heat exchange element 88 and by the steam extracted from the high pressure steam turbine 3 and flowing through the second heat exchange element 89 of the heat exchanger 87. The superheated vapor of the mixed medium is fed to the mixed medium turbine 95 through the pipe 94, to drive the turbine by its expansion work. Here, since the mixed medium turbine 95 is coupled coaxially with the high pressure steam turbine 3 and the power generator 4, the rotational energy of the mixed medium turbine 95 can be transduced into electric energy by the power generator 4.

The mixed medium exhausted by the mixed medium turbine 95 is fed to the mixer 97 through the exhaust pipe 96, and then mixed with the mixed medium fed from the liquid phase portion of the separator 85 and flowing into the mixer 97 through the pipe 105. Here, before being mixed, the mixed medium fed from the separator 85 is cooled by the mixed medium condensed by the medium condenser 99 when flowing through the heat exchange element 104 of the heat exchanger 101. Further, since the separator 85 is maintained at a pressure higher than that of the mixer 97, the mixed medium fed from the separator 85 is depressurized by the pressure reduction valve 106 before being mixed. Further, in order to increase the mixing efficiency, the mixed medium of liquid phase portion fed from the separator 85 is jetted into the mixer 97.

As described above, although the vapor extracted from the mixed medium turbine 95 is mixed with the mixed medium fed from the liquid phase portion of the separator 85, since the concentration (abundance ratio) of the low boiling point components of the mixed medium forming the liquid phase portion of the separator 85 is low, after having been mixed, the concentration of the low boiling point components of the mixed medium can be reduced. Further, the vapor extracted from the mixed medium turbine 95 and the mixed medium of liquid phase fed from the separator 85 are mixed by the mixer 97 into a two-phase stream. The mixed medium of two-phase stream is fed to the medium condenser 99. Here, a heat exchange element (not shown) is provided within the medium condenser 99, and further salt water of the normal temperature is flowing through the heat exchange element. Therefore, the mixed medium of two-phase stream fed to the medium condenser 99 is cooled and condensed into liquid by the salt water flowing through the heat exchange element. Here, since the concentration of the low boiling point components of the mixed medium of two-phase stream introduced into the medium condenser 99 is previously lowered, when cooled by the salt water of the normal temperature, it is possible to maintain the internal pressure of the medium condenser 99 at about the atmospheric pressure. As described above, since the mixed medium turbine 95 is driven by the mixed medium having a high concentration of the low boiling point components and since the vapor extracted from the mixed medium turbine 95 is condensed after the concentration of the low boiling point components thereof has been reduced, it is possible to increase the pressure on the inlet side and to decrease the back pressure on the outlet side of the mixed medium turbine 95, so that the thermal drop of the mixed medium turbine 95 can be increased.

The mixed medium condensed into liquid by the medium condenser 99 is pressurized to a high pressure by the liquid supply pump 102, and then fed to the heat exchanger 101 through the pipe 100. The mixed medium (condensed liquid) introduced into the heat exchanger 101 is heated by the heat exchange element 104 of the heat exchanger 101, and then fed to the steam condenser 81 through the pipe 103. The mixed medium fed to the steam condenser 81 is further heated and boiled by the steam extracted from the high pressure steam turbine 3 flowing through the intra-condenser heat exchange element 83, into a two-phase stream. The boiled two-phase stream is recirculated into the separator 85 through the pipe 84.

As described above, in the fourth embodiment of the power plant according to the present invention, electricity can be generated on the basis of two systems of the steam system and the mixed medium system; the mixed medium which contains components having a boiling point lower than that of water is used; and the concentration (abundance ratio) of the low boiling point components in the mixed medium is changed by use of the separator 85 before and after the mixed medium turbine 95. Therefore, since the vapor conditions on the inlet side of the mixed medium turbine 95 can be optimized so as to secure a sufficient back pressure, the driving force of the mixed medium turbine 95 driven by the mixed medium stream can be increased, with the result that it is possible to improve the thermal efficiency of the turbine 95 markedly, in comparison with the ordinary Rankin cycle. For instance, when the fourth embodiment is applied to the conventional BWR, it is possible to improve the thermal efficiency by about 1 to 2%.

Further, in the fourth embodiment, since the back pressure of the mixed medium turbine 95 can be set to or near the atmospheric pressure, the number of expansion stages of the mixed medium turbine 95 can be reduced and thereby the turbine can be small-sized. In addition, since the countermeasures of the medium condenser 99 against a high vacuum are not required, it is possible to reduce the manufacturing cost thereof. Further, being different from the conventional BWR low pressure steam turbine, it is unnecessary to form moisture-removing grooves on the back blades, to provide a structure for removing moisture effectively from the turbine casing, or to install moisture removing pipes formed of a costly chromium steel, with the result that the manufacturing cost can be further reduced.

Further, since the inner pressure of the steam condenser 81 can be set to or near the atmospheric pressure, in the same way as with the case of the medium condenser 99, the countermeasures of the steam condenser 81 against a high vacuum are not required, so that it is possible to reduce the manufacturing cost thereof markedly.

Further, since electric power is generated by the steam system by using light water as the coolant of the nuclear reactor 1 in the same way as is conventional, and by the mixed medium system (separated from the steam system) by using the mixed medium, it is possible to avert such a problem that harmful substances (corrosive substances) are produced due to the radiolyses of the mixed medium.

Further, although the fourth embodiment applied to the power plant using the nuclear reactor 1 as a heat source has been described by way of example, without being limited only thereto, it is of course possible to apply the embodiment of the present invention to various power plants which use thermal energy, geothermal energy, waste heat recovery energy, etc. as the heat source.

(Fifth embodiment)

A fifth embodiment of the power plant according to the present invention will be described hereinbelow with reference to FIG. 5, in which the same reference numerals have been retained for similar elements having the same functions as with the case of the first to fourth embodiments shown in FIGS. 1 to 4, without repeating the similar description thereof.

Figure 5:
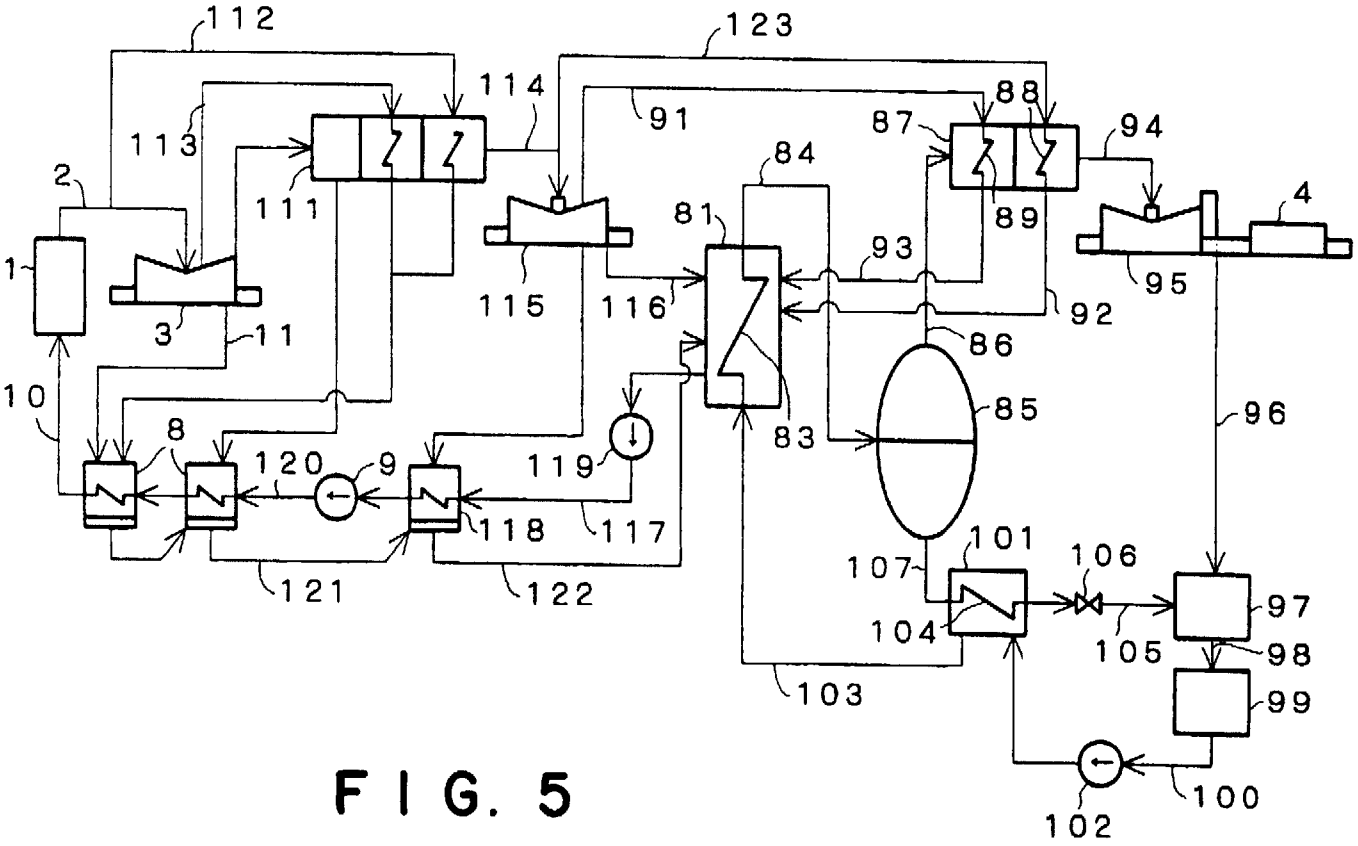
FIG. 5 is a system diagram showing a fifth embodiment of the power plant according to the present invention.

In this fifth embodiment, as shown in FIG. 5, in addition to the high pressure steam turbine, a low pressure steam turbine is provided. Further, the mixed medium is heated by steam exhausted from the low pressure steam turbine.

In FIG. 5, the power plant is provided with the nuclear reactor 1 as a heat source. A coolant of light water is heated by the nuclear reactor 1 to generate steam. The generated steam is fed to the high pressure turbine 3 through the main steam pipe 2, to drive the high pressure steam turbine 3. On the downstream side of the high pressure steam turbine 3, a moisture separator and reheater 111 is installed. The moisture separator and reheater 111 is connected to a heated steam pipe 112 branched from the main steam pipe 2 and to an exhausted steam pipe 113 extending from the high pressure steam turbine 3. The steam exhausted from the high pressure steam turbine 3 is fed to the moisture separator and reheater 111, separated into vapor and liquid, and further heated by high temperature steam which is fed to the moisture separator and reheater 111 through both the heated steam pipe 112 and the extracted steam pipe 113. The superheated steam heated by the moisture separator and reheater 111 is fed to a low pressure steam turbine 115 through a pipe 114, to drive the low pressure steam turbine 115. Here, the low pressure steam turbine 115 is constructed at a relatively high pressure stage in such a way that the temperature of the exhausted steam becomes 100° C. or higher. The high pressure steam turbine 2 and the low pressure steam turbine 115 are coupled coaxially with each other and also coupled coaxially with the electric power generator 4.

The outlet side of the high pressure steam turbine 115 is connected to the inlet side of the steam condenser 81 through an exhaust pipe 116. The outlet side of the steam condenser 81 is connected to a low pressure feed-water heater 118 through a condenser pipe 117. A turbine-driven or motor-driven condenser water pump 119 is provided midway of the condenser pipe 117. The outlet side of the low pressure feed-water heater 118 is connected to one of the two high pressure feed-water heaters 8 through a pipe 120. A water supply pump 9 is provided midway of the pipe 120. The outlet side of the other of the two high pressure feed-water heaters 8 is connected to the inlet side of the nuclear reactor through a reactor feed-water pipe 10. Further, to the two high pressure feed-water heaters 8, both the high pressure turbine extracted steam pipe 11 for feeding steam extracted from the high pressure steam turbine 3 and a drain pipe 112 for feeding drain water to the low pressure feed-water heater 118 are connected, respectively. Further, to the low pressure feed-water heater 118, a drain pipe 122 for feeding drain water to the steam condenser 81 is connected.

Further, the intra-condenser heat exchange element 83 is provided within the steam condenser 81, and the mixed medium is flowing at least a part of the intra-condenser heat exchange element 83. Here, the mixed medium flowing through the intra-condenser heat exchange element 83 is a mixed medium which contains two or more components, and at least one component of a plurality of components for constituting the mixed medium is a substance having a boiling point lower than that of water. As the practical example of the mixed medium, there are a mixture composed of water and ammonia; a mixture composed of two or more organic compounds which contain hydrocarbon, alcohol or ketone; a mixture composed of two or more flon-based substances; a mixture composed of water and two or more hydrophilic organic compounds (alcohol, etc.); a mixture composed of two or more organic compounds which contain hydrocarbon, alcohol or ketone and flon-based substances, etc.

The outlet side of the intra-condenser heat exchange element 83 provided within the steam condenser 81 is connected to the separator 85 through the pipe 84, and the separator 85 is connected to the inlet side of the heat exchanger 87 through the pipe 86. Within the heat exchanger 87, a first heat exchange element 88 and a second heat exchange element 89 are provided. The inlet end of the first heat exchange element 88 is connected to a midway portion of the pipe 114 through a superheated steam extracting pipe 123, and the second heat exchange element 89 is connected to the low pressure steam turbine 115 through an extracted steam pipe 91. Further, the outlet ends of both the first and second heat exchange elements 88 and 89 are connected to the steam condenser 81 through two pipes 92 and 93, respectively.

The outlet side of the heat exchanger 87 is connected to the inlet side of the mixed medium turbine 95 through the pipe 94. The mixed medium turbine 95 is coupled coaxially with the high pressure steam turbine 3, the low pressure steam turbine 115, and further the electric power generator 4. The outlet side of the mixed medium turbine 95 is connected to the inlet side of the mixer 97 through the exhaust pipe 96, and the outlet side of the mixer 97 is connected to the inlet side of the medium condenser 99 through the pipe 98. A heat exchange element (not shown) is provided within the medium condenser 99, and salt water is flowing through the heat exchange element. The outlet side of the medium condenser 99 is connected to the inlet side of the heat exchanger 101 through a pipe 100, and a liquid supply pump 102 is provided midway of the pipe 100. The outlet side of the heat exchanger 101 is connected to the inlet end of the intra-condenser heat exchange element 83 of the steam condenser 81 through a pipe 103. Further, a heat exchange element 104 is provided within the heat exchanger 101, and the outlet end of the heat exchange element 104 is connected to the mixer 97 through a pipe 105. A pressure reduction valve 106 is provided midway of the pipe 105. The inlet end of the heat exchange element 104 is connected to the lower portion of the separator 85 through a pipe 107.

The operation of the fifth embodiment constructed as described above will be described hereinbelow.

The coolant of light water is heated by the nuclear reactor 1 into saturated steam, and then fed to the high pressure steam turbine 3 through the main steam pipe 2. The steam fed to the high pressure steam turbine 3 drives the high pressure steam turbine 3, so that the rotational energy of the turbine is transduced into electric energy by the power generator 4. The steam exhausted from the high pressure steam turbine 3 is heated by the moisture separator and reheater 111 into superheated steam, and then fed to the low pressure steam turbine 115 through the pipe 114. The steam fed to the low pressure steam turbine 115 drives the low pressure steam turbine 115, so that the rotational energy of the turbine is transduced into electric energy by the power generator 4.

The temperature of the steam exhausted from the low pressure steam turbine 115 is 100° C. or higher. The exhausted steam is fed to the steam condenser 81 through the pipe 116, and cooled and condensed by the mixed medium flowing through the intra-condenser heat exchange element 83. Here, the internal pressure of the steam condenser 81 can be set to a pressure near or beyond the atmospheric pressure. The condensed water formed by the steam condenser 81 is fed to the low pressure feed-water heater 118 by the condenser pump 119 and heated, and further pressurized by the water supply pump 9, and then fed to the high pressure feed-water heaters 8 through the pipe 120. The condensed water fed to the high pressure feed-water heaters 8 is heated by the steam fed through the high pressure turbine exhausted steam pipe 11 and the other pipes extending from the moisture separating reheater 111, and then recirculated into the nuclear reactor 1 through the reactor feed-water pipe 10, after having been heated to an appropriate subcooled temperature.

On the other hand, the mixed medium flowing through the intra-condenser heat exchange element 83 of the steam condenser 81 is heated by the steam exhausted from the low pressure steam turbine 115 and fed to the steam condenser 81 through the exhaust pipe 116, the extracted superheated steam fed into the steam condenser 81 through the pipe 92, the steam extracted from the low pressure steam turbine 115 and fed into the steam condenser 81 through the pipe 93, and water drained from the low pressure feed-water heater 118 and fed into the steam condenser 81 through the drain pipe 122. After having been boiled into a two-phase stream, the mixed medium heated by the steam condenser 81 is fed to the separator 85 through the pipe 84.

The mixed medium fed to the separator 85 is separated by distillation using gravity into a liquid phase portion (formed of liquid) and a vapor phase portion (formed of vapor). In the vapor of the mixed medium (which forms the vapor phase portion), the concentration (abundance ratio) of the low boiling point component thereof is heightened. The vapor which contains much low boiling point components is fed to the heat exchanger 87 through the pipe 86. The vapor of the mixed medium fed to the heat exchanger 87 is heated to superheated vapor by the superheated steam flowing through the second heat exchange element 89 and by the steam extracted from the low pressure steam turbine 115 and flowing through the first heat exchange element 88 of the heat exchanger 87. The superheated vapor of the mixed medium is fed to the mixed medium turbine 95 through the pipe 94, to drive the turbine by its expansion work. Here, since the mixed medium turbine 95 is coupled coaxially with the high pressure steam turbine 3, the low pressure steam turbine 115, and further the power generator 4, the rotational energy of the mixed medium turbine 95 can be transduced into electric energy by the power generator 4.

The mixed medium exhausted from the mixed medium turbine 95 is fed to the mixer 97 through the exhaust pipe 96, and then mixed with the mixed medium fed from the liquid phase portion of the separator 85 and introduced into the mixer 97 through the pipe 105. Here, before being mixed, the mixed medium fed from the separator 85 is cooled by the mixed medium condensed by the medium condenser 99 when flowing through the heat exchange element 104 of the heat exchanger 101. Further, since the separator 85 is maintained at a pressure higher than that of the mixer 97, the mixed medium fed from the separator 85 is depressurized by the pressure reduction valve 106 before being mixed. Further, in order to increase the mixing efficiency, the mixed medium of liquid phase fed from the separator 85 is jetted into the mixer 97.

As described above, although the vapor extracted from the mixed medium turbine 95 is mixed with the mixed medium fed from the liquid phase portion of the separator 85, since the concentration (abundance ratio) of the low boiling point components is low in the mixed medium for forming the liquid phase portion of the separator 85, after having been mixed, the concentration of the low boiling point components is reduced. Further, the vapor extracted from the mixed medium turbine 95 and the mixed medium of liquid phase fed from the separator 85 are mixed by the mixer 97 into a two-phase stream. The mixed medium of two-phase stream is fed to the medium condenser 99 through the pipe 98. Here, a heat exchange element (not shown) is provided within the medium condenser 99, and further salt water of the normal temperature is flowing through the heat exchange element. Therefore, the mixed medium of two-phase stream fed to the medium condenser 99 is cooled and condensed into liquid by the salt water flowing through the heat exchange element. Here, since the concentration of the low boiling point components of the mixed medium of two-phase stream introduced into the medium condenser 99 is previously lowered by the mixer 97, when cooled by the salt water of the normal temperature, it is possible to set the internal pressure of the medium condenser 99 to about the atmospheric pressure. As described above, since the mixed medium turbine 95 is driven by the mixed medium having a high concentration of the low boiling point components and since the vapor extracted from the mixed medium turbine 95 is condensed after the concentration of the low boiling point components thereof has been reduced, it is possible to increase the pressure on the inlet side and to decrease the back pressure on the outlet side of the mixed medium turbine 95, so that the thermal drop of the mixed medium turbine 95 can be increased.

The mixed medium condensed into liquid by the medium condenser 99 is pressurized to a high pressure by the liquid supply pump 102, and then fed to the heat exchanger 101 through the pipe 100. The mixed medium (condensed liquid) introduced into the heat exchanger 101 is heated by the heat exchange element 104 of the heat exchanger 101, and then fed to the steam condenser 81 through the pipe 103. The mixed medium fed to the steam condenser 81 is further heated and boiled into a two-phase stream by the steam extracted from the high pressure steam turbine 3 and flowing through the intra-condenser heat exchange element 83. The boiled two-phase stream is recirculated into the separator 85 through the pipe 84.

As described above, in the fifth embodiment of the power plant according to the present invention, electricity can be generated by use of three systems of the high pressure steam system, the low pressure steam system, and the mixed medium system; the mixed medium which contains components having a boiling point lower than that of water is used; and the concentration (abundance ratio) of the low boiling point components of the mixed medium is changed by use of the separator 85 before and after the mixed medium turbine 95. Therefore, since the vapor conditions on the inlet side of the mixed medium turbine 95 can be optimized so as to secure a sufficient back pressure, the driving force of the mixed medium turbine 95 driven by the mixed medium stream can be increased, so that it is possible to improve the thermal efficiency markedly in comparison with the ordinary Rankin cycle.

Further, in the low pressure steam turbine 115, being different from the low pressure steam turbine of the conventional BWR, since the lower pressure stages are not used, the countermeasures against moisture are not required, so that the manufacturing cost can be reduced markedly.

Further, in the fifth embodiment, since the back pressure of the mixed medium turbine 95 can be set to or near the atmospheric pressure, the number of expansion stages of the mixed medium turbine 95 can be reduced and thereby the turbine can be small-sized. In addition, since the countermeasures of the medium condenser 99 against a high vacuum are not required, it is possible to reduce the manufacturing cost thereof.

Further, since the inner pressure of the steam condenser 81 can be set to or near the atmospheric pressure, in the same way as with the case of the medium condenser 99, the countermeasures of the steam condenser 81 against a high vacuum are not required, so that it is possible to reduce the manufacturing cost thereof markedly.

Further, since electric power can be generated by the two steam systems of high and low pressures by using light water as the coolant of the nuclear reactor 1 in the same way as is conventional, and by the mixed medium system (separated from the steam system) by using the mixed medium, it is possible to avert such a problem that harmful substances (corrosive substances) are produced due to the radiolyses of the mixed medium.

Further, although the fifth embodiment applied to the power plant which uses the nuclear reactor 1 as a heat source has been described by way of example, without being limited only thereto, it is of course possible to apply the fifth embodiment of the present invention to various power plants which use thermal energy, geothermal energy, waste heat recovery energy, etc. as the heat source.

(Sixth embodiment)

A sixth embodiment of the power plant according to the present invention will be described hereinbelow with reference to FIG. 6, in which the same reference numerals have been retained for similar elements having the same functions as with the case of the first to fifth embodiments shown in FIGS. 1 to 5, without repeating the similar description thereof.

Figure 6:
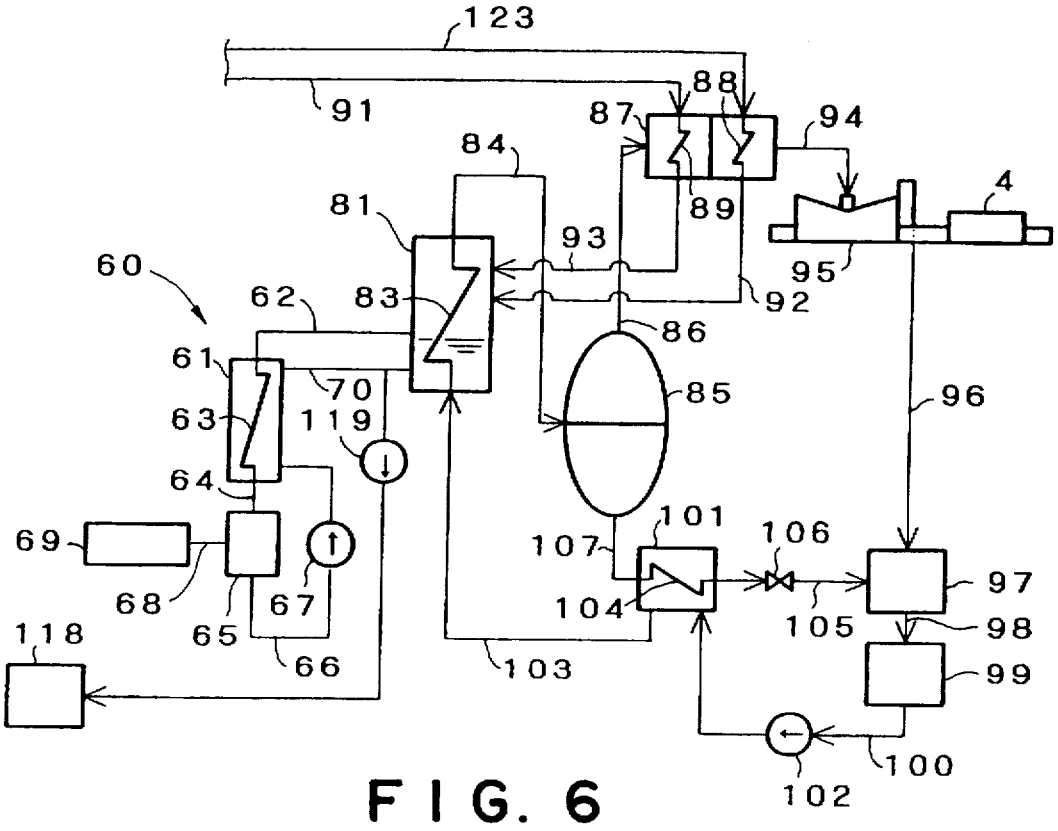
FIG. 6 is a system diagram showing a sixth embodiment of the power plant according to the present invention.
Figure 7:
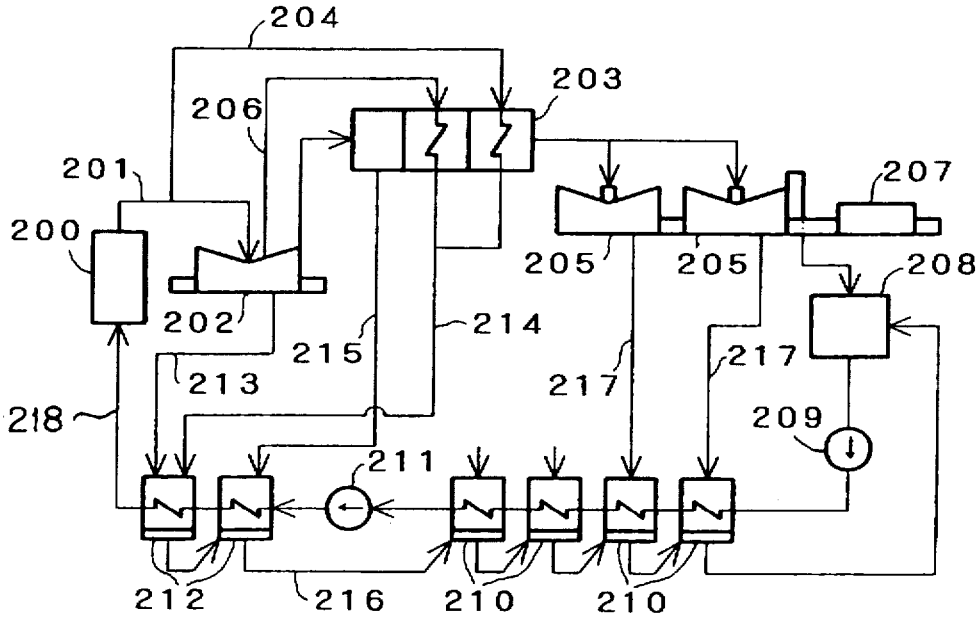
FIG. 7 is a system diagram showing a conventional power plant.

In this sixth embodiment, as shown in FIG. 6, the non-condensable gas treating system 60 (shown in FIG. 3) of the third embodiment is applied to the fourth and fifth embodiments. In more detail, 1% or less steam which contains non-condensable gas is extracted from above the liquid surface of the condensed water accumulated at the bottom portion of the steam condenser 81, and the extracted non-condensable gas is treated by the non-condensable gas treating system 60.

In this sixth embodiment, in the same way as with the case of the third embodiment, since the non-condensable gas produced by the radiolyses due to the radiations from the nuclear reactor can be treated by a system considerably smaller than the conventional treating system installed in the nuclear power plant, it is possible to reduce the manufacturing cost markedly.

As described above, in the power plant according to the present invention, since the steam system including the steam turbine and the mixed medium system including the mixed medium turbine are installed; since the mixed medium is heated by the steam exhausted from the steam turbine; and further since the concentration (abundance ratio) of the low boiling point components of the mixed medium is increased or decreased before and after the mixed medium turbine, it is possible to increase the thermal efficiency markedly, as compared with the conventional power plant.

What is claimed is:

1. A power plant, comprising:

a steam system having:

a heat source for heating a water to generate a steam;

a steam turbine driven by the steam generated by said heat source;

a steam condenser for forming a condensed water by condensing an exhaust of said steam turbine; and condensed water feeding means for feeding the condensed water produced by said steam condenser to said heat source; and a mixed medium system having:

heat exchanging means for exchanging heat between the exhaust of said steam turbine and a mixed medium;

high pressure separating means for separating the mixed medium heated by said heat exchanging means into liquid and vapor;

a mixed medium turbine driven by the mixed medium of vapor phase separated by said high pressure separating means;

first medium condensing means for forming a condensed liquid by condensing an exhaust of said mixed medium turbine;

first condensed liquid heating means for heating the condensed liquid formed by said first medium condensing means;

intermediate pressure separating means for separating the condensed liquid heated by said first condensed liquid heating means into liquid and vapor;

first condensed liquid feeding means for feeding the condensed liquid formed by said first medium condensing means to said intermediate pressure separating means;

mixing means for mixing the mixed medium of liquid phase separated by said intermediate pressure separating means with the exhaust of said mixed medium turbine on upstream side of said first medium condensing means;

second medium condensing means for forming a condensed liquid by cooling the mixed medium of vapor phase separated by said intermediate pressure separating means;

second condensed liquid feeding means for feeding the condensed liquid formed by said second medium condensing means to said heat exchanging means; and first separated liquid feeding means for feeding the mixed medium of liquid phase separated by said high pressure separating means to said intermediate pressure separating means.

2. The power plant according to claim 1, wherein the condensed liquid formed by said first medium condensing means is heated at the same time that the mixed medium of vapor phase separated by said intermediate pressure separating means is cooled, by exchanging heat between the condensed liquid and the mixed medium of vapor phase.

3. The power plant according to claim 1, which further comprises:

second condensed liquid heating means for heating the condensed liquid formed by said second medium condensing means;

intermediate high pressure separating means for separating the condensed liquid heated by said second condensed liquid heating means into liquid and vapor;

third medium condensing means for forming a condensed liquid by cooling the mixed medium of vapor phase separated by said intermediate high pressure separating means; and second separated liquid feeding means for feeding the mixed medium of liquid phase separated by said high pressure separating means to said intermediate high pressure separating means; and wherein said second condensed liquid feeding means feeds the condensed liquid formed by said third medium condensing means to said heat exchanging means; and said first separated liquid feeding means feeds the mixed medium of liquid phase separated by said intermediate high pressure separating means to said intermediate pressure separating means.

4. The power plant according to claim 3, wherein the condensed liquid formed by said second medium condensing means is heated at the same time that the mixed medium of vapor phase separated by said intermediate high pressure separating means is cooled, by exchanging heat between the condensed liquid and the mixed medium of vapor phase.

5. The power plant according to claim 1, which further comprises:

a small-sized steam condenser for condensing the steam within said steam condenser which contains non-condensable gas; and non-condensable gas treating means for treating the non-condensable gas existing within said small-sized steam condenser.

6. The power plant according to claim 1, wherein said heat source is a nuclear reactor.

7. The power plant according to claim 1, wherein the mixed medium is a mixture which contains at least a water and an ammonia.

8. A power plant, comprising:

a steam system having:

a heat source for heating a water to generate a steam;

a steam turbine driven by the steam generated by said heat source;

a steam condenser for forming a condensed water by condensing an exhaust of said steam turbine; and condensed water feeding means for feeding the water condensed by said steam condenser to said heat source; and a mixed medium system having:

heat exchanging means for exchanging heat between the exhaust of said steam turbine and a mixed medium;

separating means for separating the mixed medium heated by said heat exchanging means into liquid and vapor;

a mixed medium turbine driven by the mixed medium of vapor phase separated by said separating means;

mixing means for mixing the exhaust of said mixed medium turbine with the mixed medium of liquid phase separated by said separating means;

medium condensing means for forming a condensed liquid by condensing the mixed medium mixed by said mixing means; and condensed liquid feeding means for feeding the condensed liquid formed by said medium condensing means to said heat exchanging means.

9. The power plant according to claim 8, wherein said steam turbine comprises:

a high pressure steam turbine driven by the steam generated by said heat source;

a low pressure turbine driven by an exhaust of said high pressure steam turbine; and wherein said heat exchanging means exchanges heat between the exhaust of said low pressure steam turbine and the mixed medium.

10. The power plant according to claim 8, which further comprises:

a small-sized steam condenser for condensing the steam within said steam condenser which contains non-condensable gas; and non-condensable gas treating means for treating the non-condensable gas existing within said small-sized steam condenser.

11. The power plant according to claim 8, wherein said heat source is a nuclear reactor.

12. The power plant according to claim 8, wherein the mixed medium is a mixture which contains at least a water and an ammonia.

* * * * *